US007106205B2

(12) United States Patent
Graef et al.

(10) Patent No.: US 7,106,205 B2
(45) Date of Patent: Sep. 12, 2006

(54) ALARM DEVICE FOR USE WITH FALL PROTECTION EQUIPMENT

(75) Inventors: James H. Graef, Grimsby (CA); Emmett G. McGregor, Calgary (CA)

(73) Assignee: D B Industries, Inc., Red Wing, MN (US)

( * ) Notice: Subject to any disclaimer, the term of this patent is extended or adjusted under 35 U.S.C. 154(b) by 163 days.

(21) Appl. No.: 10/944,469

(22) Filed: Sep. 16, 2004

(65) Prior Publication Data

US 2006/0055545 A1 Mar. 16, 2006

(51) Int. Cl.
*G08B 23/00* (2006.01)

(52) U.S. Cl. ..... 340/573.1; 340/673; 340/679; 340/680; 340/685; 340/687; 340/457.1; 182/3; 182/46

(58) Field of Classification Search ..... 340/573.1, 340/673, 679, 680, 685, 687, 457.1; 182/3, 182/18, 35, 46; 188/222, 371, 372
See application file for complete search history.

(56) References Cited

U.S. PATENT DOCUMENTS 4,660,679 A 4/1987 Ostrobrod
4,846,313 A 7/1989 Sharp
4,944,056 A 7/1990 Schroeder et al.
5,174,410 A 12/1992 Casebolt
5,279,385 A * 1/1994 Riches et al. ..... 182/3
5,601,434 A 2/1997 Winters
5,903,219 A 5/1999 Chen
6,265,983 B1 7/2001 Baillargeon
6,279,680 B1 8/2001 Casebolt
6,330,931 B1 12/2001 Baillargeon et al.
6,488,118 B1 * 12/2002 Corriveau ..... 182/36

* cited by examiner

*Primary Examiner*—Hung Nguyen
(74) *Attorney, Agent, or Firm*—IPLM Group, P.A.

(57) ABSTRACT

A preferred embodiment alarm device for use with fall protection equipment includes an elongating member, an alarm, an activation member, and a connecting member. The elongating member has a first end and a second end and extends in length as the first end and the second end are pulled in different directions. The alarm is operatively connected to the first end of the elongating member, and the activation member is releasably connected to the alarm. The activation member activates the alarm when disconnected from the alarm. The connecting member interconnects the activation member and the second end of the elongating member, and the activation member becomes disconnected from the alarm when the elongating member is extended in length as the first end and the second end are pulled in different directions thereby activating the alarm when the elongating member is extended.

19 Claims, 8 Drawing Sheets

ALARM DEVICE FOR USE WITH FALL PROTECTION EQUIPMENT

BACKGROUND OF THE INVENTION

1. Field of the Invention

The present invention relates to an alarm device for use with fall protection equipment.

2. Description of the Prior Art

With regard to one possible application of the present invention, motorized tugger lines (winch lines on hoists commonly referred to as tuggers) are commonly used in the petroleum drilling industry to raise and/or lower equipment and/or workers up to and down from a derrick. A derrick is a framework over a drill hole (as of an oil well) for supporting boring tackle and/or for hoisting and lowering equipment and/or workers. Commonly, a worker will sit on a boatswain chair connected to the tugger line.

A risk of using motorized tugger lines is the possibility of workers getting caught on obstructions such as the oil derrick structure or other structures as the workers are being raised and/or lowered by the tugger lines. If a worker gets caught on an obstruction, the tugger continues to pull the tugger line thereby continuing to pull the worker, which could result in serious injury or death. "Man-rated" tuggers are available and typically include a clutch mechanism that limits the load of the tuggers to reduce the risk of injury to the workers. Once a predetermined load on the tugger line is reached, the "man-rated" tugger stops pulling the tugger line. However, even with "man-rated" tuggers having such a built-in safety precaution, the "man-rated" tuggers may actually provide a false sense of security and may still have risks of serious injury or death should workers get caught on obstructions. Typical "man-rated" tuggers lift from approximately 1,000 to 40,000 pounds, which is questionable for safety purposes.

With regard to another possible application of the present invention, shock absorbing devices are commonly used with fall protection equipment to reduce the force of a fall on workers. Should a worker fall, the worker may need to be rescued, especially if the worker has been injured during the fall. In some instances, it is critical to rescue a worker within a relatively short period of time. One example is to prevent the onset of orthostatic intolerance when unconscious and/or immobile workers are suspended in their harnesses unable to move their legs. Therefore, timely rescue may be critical.

SUMMARY OF THE INVENTION

A preferred embodiment alarm device for use with fall protection equipment includes an elongating member, an alarm, an activation member, and a connecting member. The elongating member has a first end and a second end and extends in length as the first end and the second end are pulled in different directions. The alarm is operatively connected to the first end of the elongating member, and the activation member is releasably connected to the alarm. The activation member activates the alarm when disconnected from the alarm. The connecting member interconnects the activation member and the second end of the elongating member, and the activation member becomes disconnected from the alarm when the elongating member is extended in length as the first end and the second end are pulled in different directions thereby activating the alarm when the elongating member is extended.

A preferred embodiment alarm device for use with a load limiting device includes an elongating member, an alarm, an activation member, and a connecting member. The elongating member has a first end, a second end, and an interconnected portion interconnecting the first end and the second end. The interconnected portion is formed by a first portion and a second portion releasably connected to one another, and the elongating member extends in length as the first end and the second end are pulled in different directions and the first portion and the second portion separate from one another as the first end and the second end are pulled in different directions. The first portion and the second portion become completely separating when the first end and the second end are pulled in different directions a distance greater than twice the length of the interconnected portion. The alarm is operatively connected to the first end of the elongating member. The activation member is releasably connected to the alarm and activates the alarm when disconnected from the alarm. The connecting member interconnects the activation member and the second end of the elongating member and becomes disconnected from the alarm when the elongating member is extended in length as the first end and the second end are pulled in different directions thereby activating the alarm when the elongating member is extended.

A preferred embodiment alarm device for use with a shock absorbing device to arrest a worker's fall includes an elongating member, an alarm, an activation member, and a connecting member. The elongating member has a first end, a second end, and an interconnected portion interconnecting the first end and the second end. The interconnected portion is formed by a first portion and a second portion releasably connected to one another. The first portion and the second portion are operatively connected to one another proximate a terminal end of the interconnected portion. The elongating member extends in length as the first end and the second end are pulled in different directions and the first portion and the second portion separate from one another as the first end and the second end are pulled in different directions. The first portion and the second portion remain connected proximate the terminal end when the first end and the second end are pulled in different directions a distance less than to substantially equal to twice the length of the interconnected portion thereby arresting the worker's fall. The alarm is operatively connected to the first end of the elongating member, and the activation member is releasably connected to the alarm and activates the alarm when disconnected from the alarm. The connecting member interconnects the activation member and the second end of the elongating member. The activation member becomes disconnected from the alarm when the elongating member is extended in length as the first end and the second end are pulled in different directions thereby activating the alarm when the elongating member is extended.

In a preferred embodiment method of providing indication that a worker has been caught on an obstruction while being moved with a mechanical device, an indicator having an activation member and a connecting member is provided. The activation member is releasably connected to the indicator, and the connecting member is operatively connected to the activation member. The activation member provides indication upon disconnection from the indicator. An elongating member having a first end and a second end is provided, and the indicator is connected to the first end and the connecting member is connected to the second end thereby releasably interconnecting the first end and the second end of the elongating member with the indicator. The worker and the mechanical device are interconnected with the elongating member. The activation member becomes disconnected from the indicator as the first end and the second end are pulled in different directions should the worker become caught on an obstruction thereby providing indication that the worker has been caught.

In a preferred embodiment method of providing indication that a worker has been caught on an obstruction, a worker and a mechanical device are interconnected with a cable, and the worker is moved by the cable with the mechanical device. An elongating member is provided, and the elongating member increases the length of the cable when the worker has been caught on an obstruction and the mechanical device continues to move the cable. An indication when the elongating member begins to lengthen is provided thereby indicating that the worker has been caught on the obstruction. An operator of the mechanical device is allowed time to stop movement of the mechanical device upon indication that the worker has been caught on the obstruction.

In a preferred embodiment method of providing indication that a worker has fallen, an indicator having an activation member and a connecting member is provided. The activation member is releasably connected to the indicator, and the connecting member is operatively connected to the activation member. The activation member provides indication upon disconnection from the indicator. A shock absorbing device having a first end and a second end is provided, and the indicator is connected to the first end and the connecting member is connected to the second end thereby releasably interconnecting the first end and the second end of the shock absorbing device with the indicator. A worker and a support structure are interconnected with the shock absorbing device, and the activation member becomes disconnected from the indicator as the first end and the second end are pulled in different directions should the worker become subjected to the force of a fall.

DETAILED DESCRIPTION OF A PREFERRED EMBODIMENT

Figure 1:
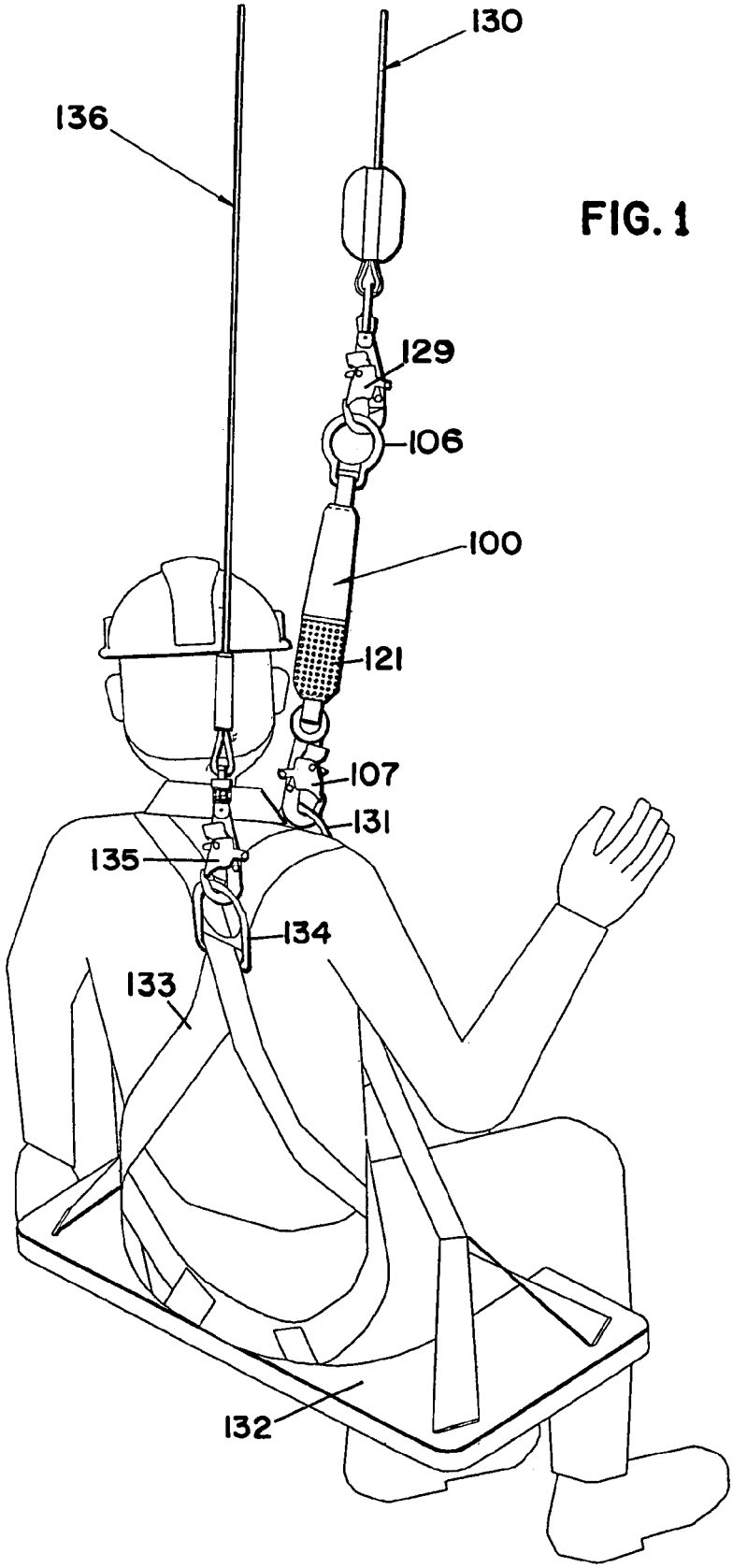
FIG. 1 is a rear perspective view of a worker utilizing a load limiting alarm device constructed according to the principles of the present invention.

The present invention may be used in many different fall protection applications. A preferred embodiment load limiting alarm device constructed according to the principles of the present invention is designated by the numeral 100 in the drawings. A preferred embodiment shock absorbing alarm device constructed according to the principles of the present invention is designated by the numeral 200 in the drawings.

In one possible application of the present invention, the load limiting alarm device 100 includes an elongating member 101, which is preferably made of webbing having a first end 104 and a second end 105 interconnected with an interconnected portion 109 formed by a first ply 102 interwoven with a second ply 103. The interconnected portion 109 is preferably made of double needle loom webbing that may be torn apart and partially to completely separated into the first ply 102 and the second ply 103 to lengthen the distance between the first end 104 and the second end 105. Thus, the elongating member 101 extends in length as the first end 104 and the second end 105 are pulled in different directions thereby separating the first ply 102 and the second ply 103. The elongating member 101 remains connected and serves as a length extending member as the first end 104 and the second end 105 are pulled in different directions a distance less than to substantially equal to twice the length of the interconnected portion 109. The elongating member 101 becomes completely separated should the first end 104 and the second end 105 be pulled in different directions a distance greater than twice the length of the interconnected portion 109.

The first end 104 includes a loop operatively connected to a first connector 106, which is preferably a ring, and the second end 105 includes a loop operatively connected to a second connector 107, which is preferably a snap hook. Although a ring and a snap hook are shown, it is recognized that other suitable connectors known in the art may be used. Stitching 108 is used to operatively connect the first end 104 to the first ply 102 and to operatively connect the second end 105 to the second ply 103.

Figure 4:
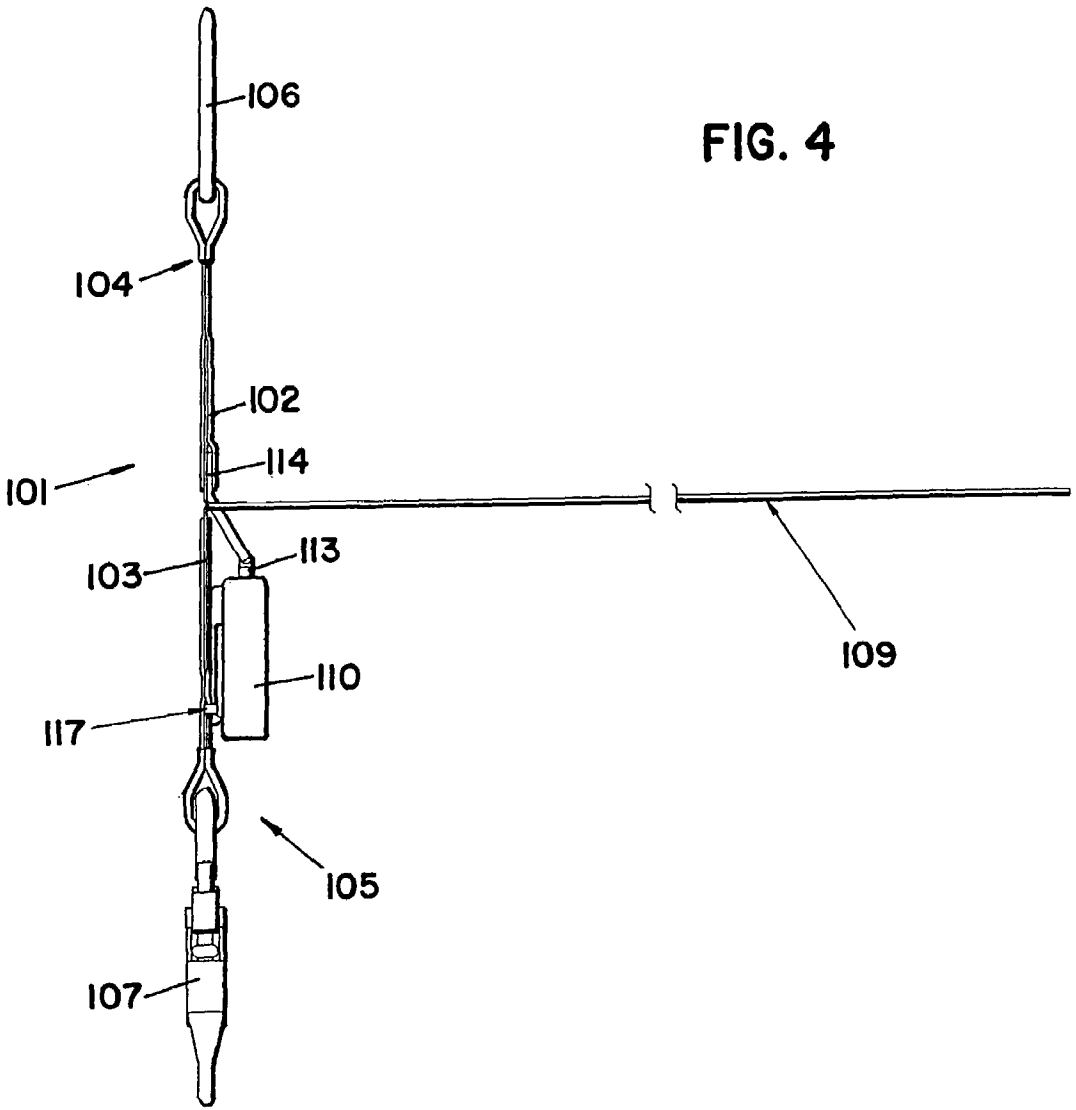
FIG. 4 is side view of the load limiting device shown in FIG. 3 with the webbing unfolded.
Figure 6:
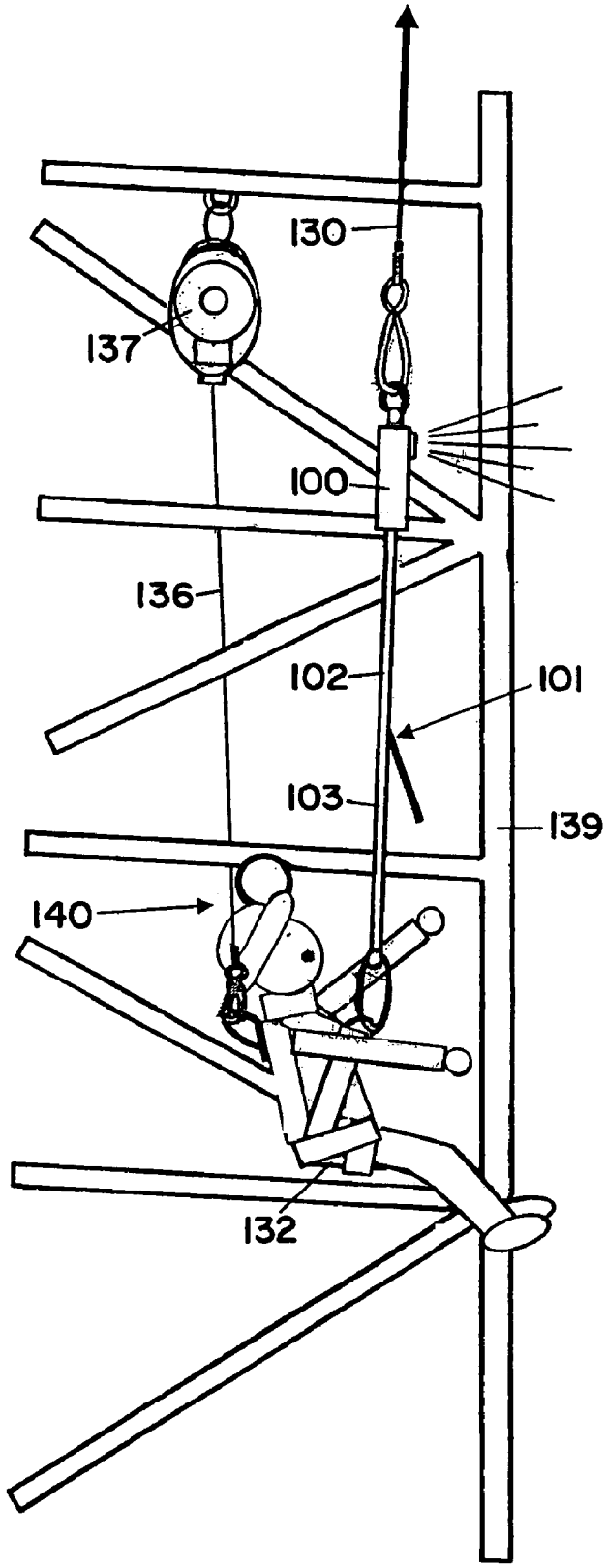
FIG. 6 is a side view of the worker getting caught on an obstruction on the oil derrick and the load limiting device shown in FIG. 5 being activated.
Figure 7:
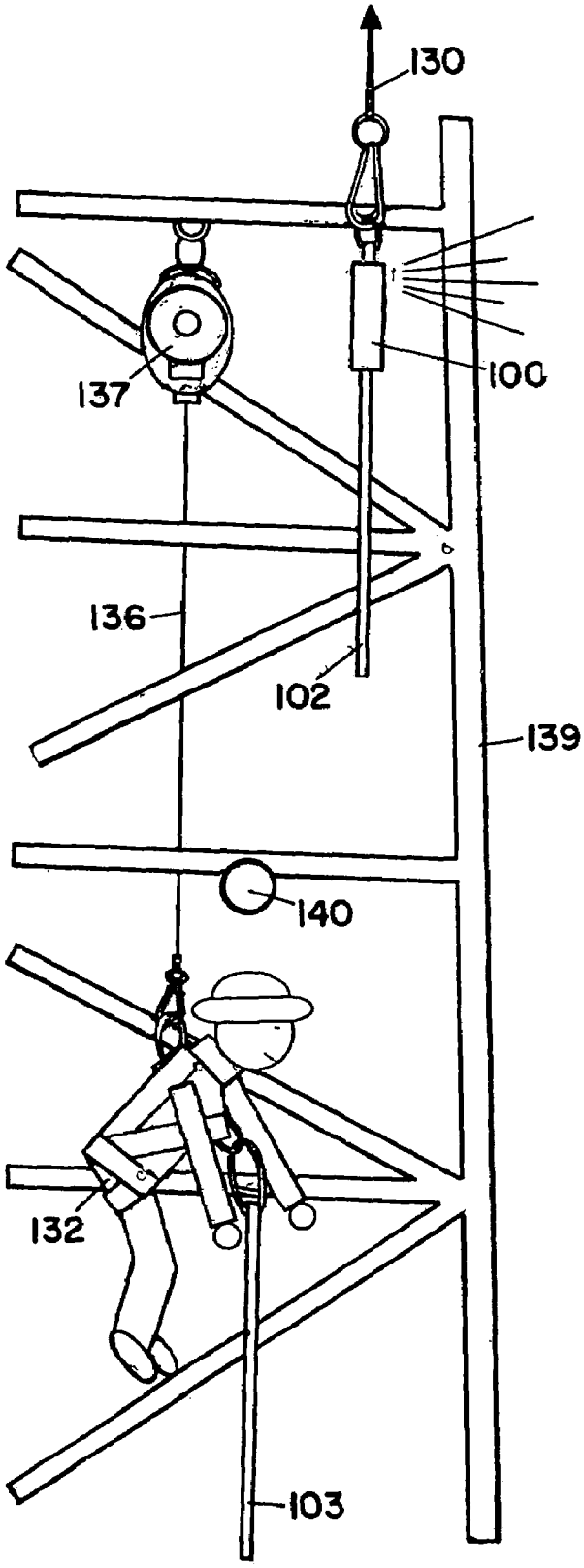
FIG. 7 is a side view of the worker released by load limiting device shown in FIG. 5 and being suspended by a self-retracting lifeline.

The preferred elongating member 101 is shown in FIGS. 4, 6, and 7. Preferably the elongating member 101 tears apart and completely separates, but it is recognized that it does not have to tear apart and completely separate. As long as the elongating member 101 allows the distance between the first end 104 and the second end 105 to increase, the elongating member 101 could lengthen by other suitable means known in the art such as by stretching of an elasticized member or a biasing member as the interconnected portion 109.

Figure 3:
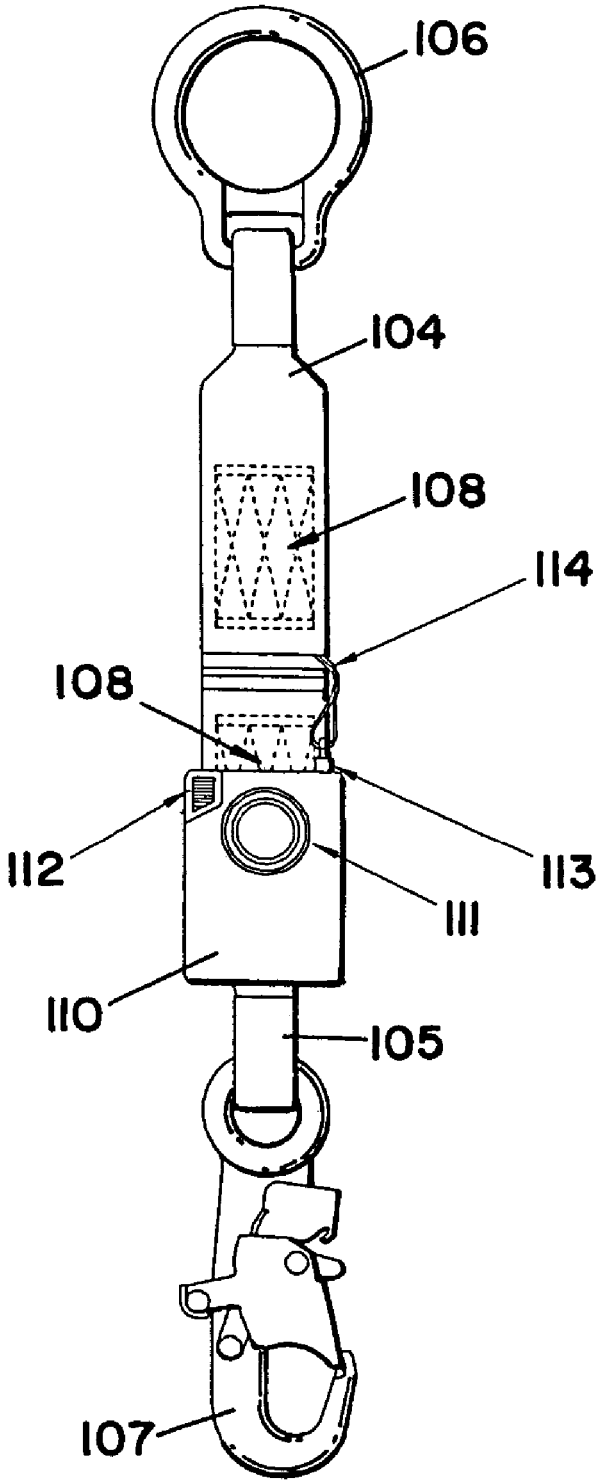
FIG. 3 is a front view of the load limiting device shown in FIG. 2 without a sleeve.

An alarm housing 110 includes a speaker 111 and an optional indicator light 112 on the top of the housing 110, as shown in FIG. 3. The housing may be integral with the speaker and the indicator light. An activation pin 113 is releasably connected to an end of the housing 110, and a connecting member 114 is operatively connected to the activation pin 113. When the activation pin 113 is disconnected from the housing 110, an alarm sounds through the speaker and the indicator light 112 illuminates to provide audio and visual indication that the activation pin 113 has been disconnected from the housing 110. The alarm could be battery operated or an air powered horn. Such alarm devices are well known in the art. An example of a suitable alarm device that may be used is disclosed in U.S. Pat. No. 5,903,219, which is incorporated by reference herein.

Figure 2:
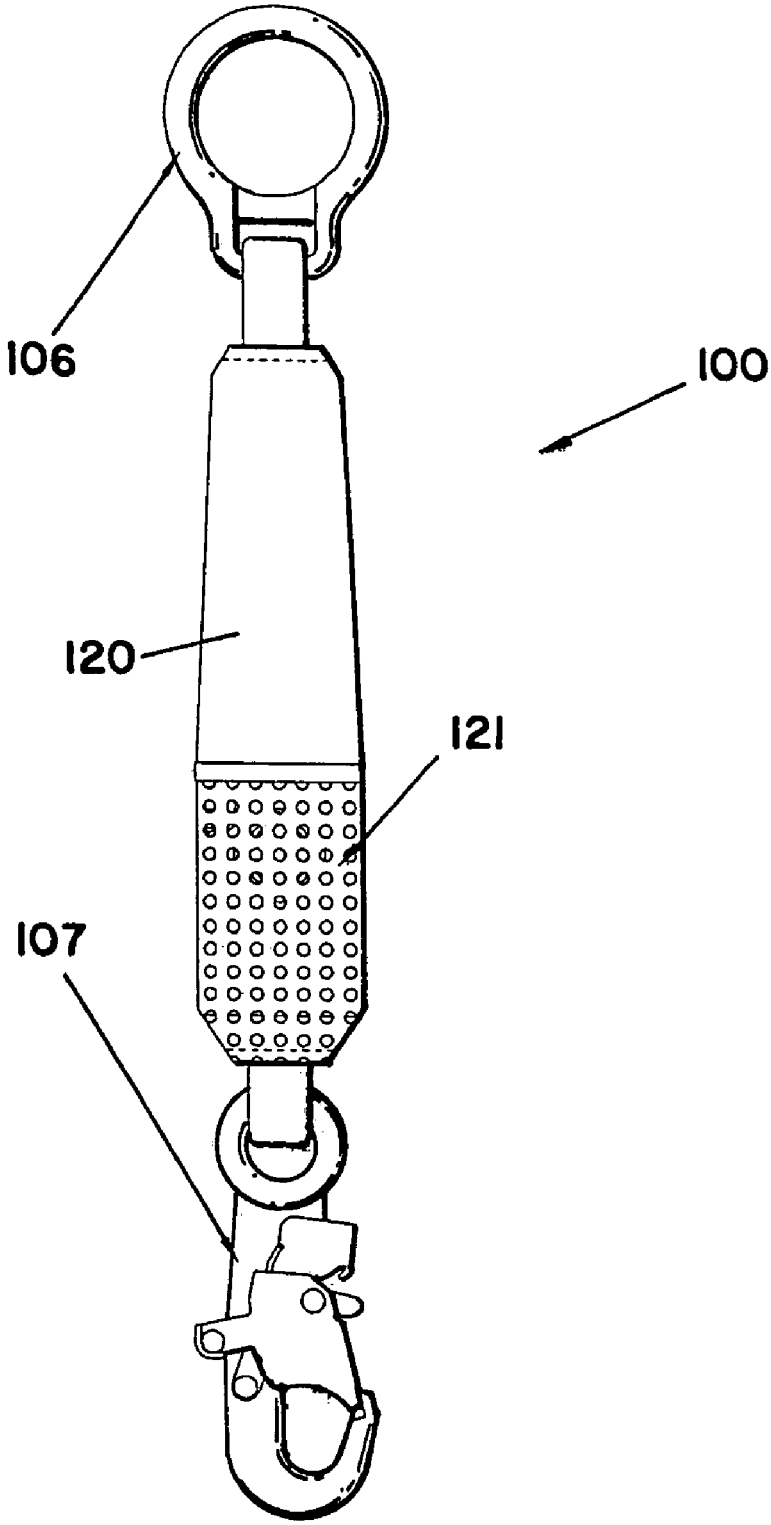
FIG. 2 is a front view of the load limiting device shown in FIG. 1.

The connecting member 114 is preferably a pull cord inserted between the first end 104 and the first ply 102 and operatively connected to the first end 104 with the stitching 108. The housing 110 is preferably operatively connected to the second end 105 with a cable tie 117 with the top of the housing 110 facing away from the second end 105. The interconnected portion 109 may be folded and a sleeve 120 may be used to contain the folded interconnected portion 109. Preferably, the sleeve 120 includes a mesh portion 121 proximate the speaker 111, as shown in FIG. 2, so that when the alarm sounds the alarm is not muffled by the sleeve 120.

Figure 5:
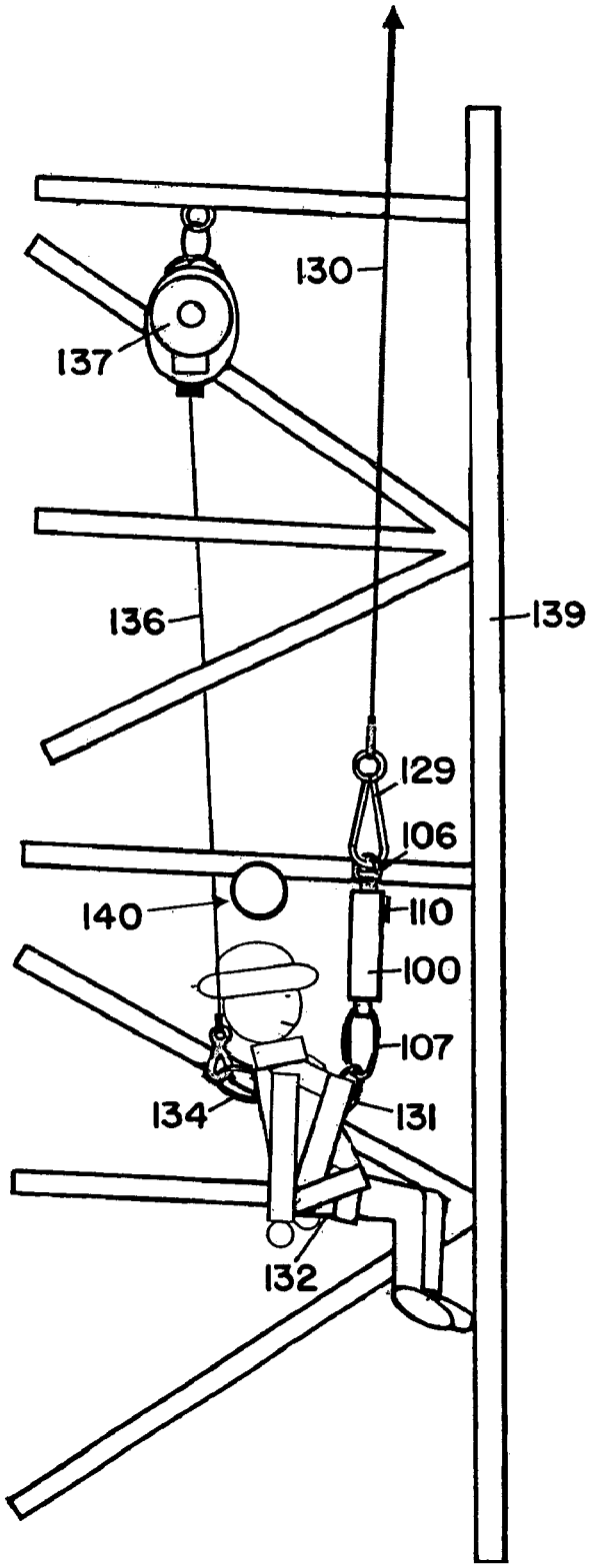
FIG. 5 is a side view of a worker utilizing the load limiting device shown in FIG. 1 as the worker is being raised by a tugger line on an oil derrick.

As shown in FIGS. 1 and 5, a cable interconnects a worker and a mechanical device, such as a tugger, which is used to move the worker by the cable. More specifically, the load limiting alarm device 100 interconnects the boatswain chair 132 upon which the worker is seated and the tugger line 130. The connector 129 of the tugger line 130 is operatively connected to the first connector 106, and the connector 131 of the boatswain chair 132 is operatively connected to the second connector 107. The safety line 136 of the self-retracting lifeline 137 is operatively connected to the dorsal D-ring 134 on the safety harness 133 donned by the worker with a snap hook 135. The tugger line 130 raises and/or lowers the worker, and the self-retracting lifeline 137 serves as a back-up fall arrest system. The worker moves with the tugger line 130 as the mechanical device moves the tugger line 130.

In operation, if the worker gets caught on an obstruction 140 of a derrick 139 as illustrated in FIG. 6, the tugger line 130 continues to move while the worker stays in a relatively constant position thereby causing the first ply 102 and the second ply 103 of the elongating member 101 will begin to separate, the connecting member 114 will be pulled away from the alarm housing 110 thereby disconnecting the activation pin 113 from the alarm housing 110, and the alarm device will be activated. In other words, when a sufficient load is placed on the elongating member 101, the interconnected portion 109 will begin to tear and elongate, pulling the connecting member 114 from the housing 110 and activating the alarm. When the alarm device is activated, an alarm will sound from speaker 111 and an indicator light 112 will illuminate. The indicator light 112 is optional. The activated alarm is intended to notify the operator of the tugger that there is a problem and that the tugger line 130 should be stopped. Preferably, the elongating member will separate into the first ply 102 and the second ply 103 to elongate approximately 10 to 14 feet and provide a sufficient amount of time for the operator of the tugger to react and stop the tugger line after hearing the alarm sound. Most preferably, as illustrated in FIGS. 6 and 7, the alarm housing 110 is attached to the upper portion of the device 100 so that as the first and second plies 102 and 103 separate the distance between the worker and the sounding alarm increases, which protects the worker's ears.

If the operator of the tugger does not react in time, as illustrated in FIG. 7, the first ply 102 and the second ply 103 will completely separate and the back-up fall arrest system, the self-retracting lifeline 137, will be used to stop the worker's fall. The complete separation of the first and second plies 102 and 103 disengages the worker from the tugger line 130, which ensures that the worker will not be seriously injured by the tugger line 130 should the operator of the tugger not react in time. Unlike an energy absorbing device, the load limiting alarm device 100 does not have any type of back-up webbing to stop a fall so a back-up fall arrest system should be used.

Figure 8:
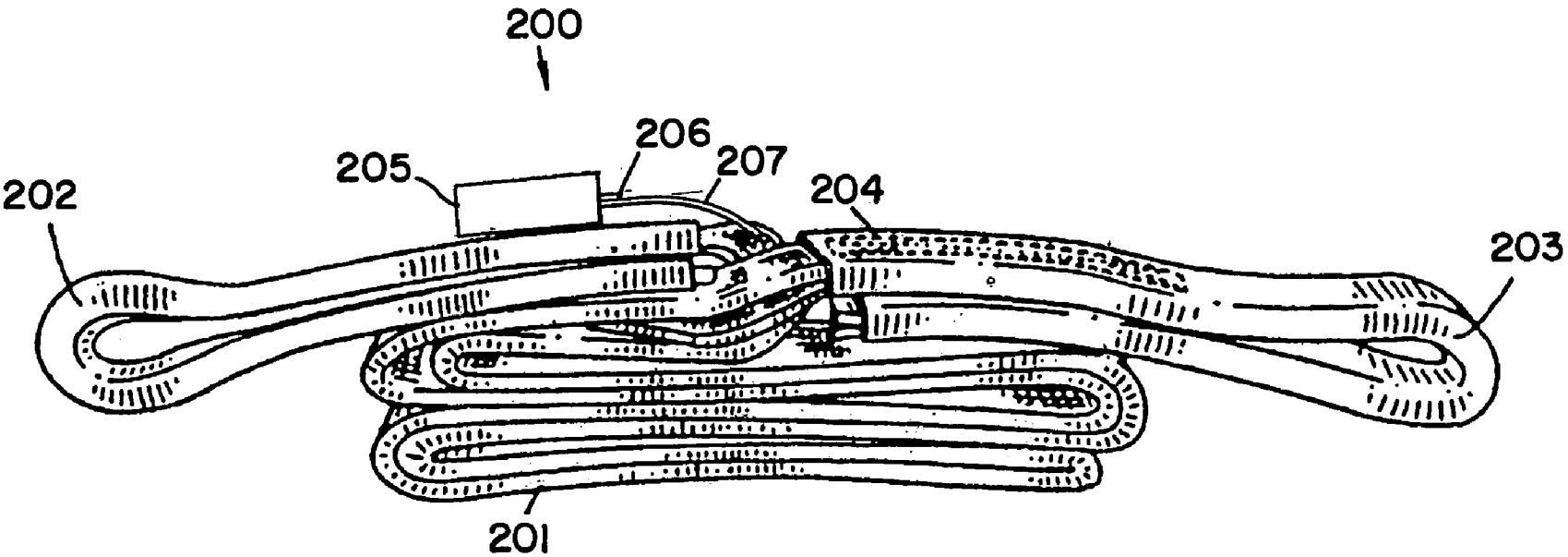
FIG. 8 is a side view of a shock absorbing alarm device constructed according to the principles of the present invention.

In another possible application of the present invention, the shock absorbing alarm device 200 includes a shock absorbing component 201 preferably made of webbing having a first end 202 and a second end 203, as shown in FIG. 8. The shock absorbing component may be any suitable shock absorbing device known in the art having two portions that separate from one another. An example of a suitable shock absorbing device is disclosed in U.S. Pat. No. 5,174,410, which is incorporated by reference herein. Another example of a suitable shock absorbing device, which is not made of webbing, is disclosed in U.S. Pat. No. 6,279,680, which is incorporated by reference herein.

Similar to the load limiting alarm device 100, the alarm housing 205 is operatively connected to the first end 202 of the shock absorbing component 201 with a cable tie (not shown) and the connecting member 207 is operatively connected to the second end 203 of the shock absorbing component 201 with stitching 204. Again, the alarm housing 205 and the alarm may be an integral unit. The activation pin 206 is operatively connected to the connecting member 207 and is releasably connected to the housing 205 thereby releasably interconnecting the housing 205 and the connecting member 207. As the two ends 202 and 203 of the shock absorbing component 201 are pulled in different directions and the two portions of the shock absorbing component 201 separate, the connecting member 207 is pulled and the activation pin 206 is disconnected from the housing 205 thereby activating the alarm sound and the optional indicator light. The two portions of the shock absorbing component 201 are releasably connected proximate one end and are operatively connected proximate an opposite, terminal end of the shock absorbing component 201. The two portions separate and absorb shock as is well known in the art until proximate the terminal end to gradually arrest the worker's fall. The alarm sound and the indicator light provide audio and visual indication that the worker has fallen and should be rescued.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An alarm device for use with fall protection equipment, comprising:

a) an elongating member having a first end and a second end, the elongating member extending in length as the first end and the second end are pulled in different directions;

b) an alarm operatively connected to the first end of the elongating member;

c) an activation member releasably connected to the alarm, the activation member activating the alarm when disconnected from the alarm; and d) a connecting member interconnecting the activation member and the second end of the elongating member, the activation member becoming disconnected from the alarm when the elongating member is extended in length as the first end and the second end are pulled in different directions thereby activating the alarm when the elongating member is extended.

2. The alarm device of claim 1, wherein the elongating member is a component of a load limiting device.

3. The alarm device of claim 1, wherein the elongating member is a component of a shock absorbing device.

4. The alarm device of claim 1, wherein the elongating member includes a first portion and a second portion releasably connected to one another, the first portion and the second portion separating to extend the elongating member in length as the first end and the second end are pulled in different directions.

5. The alarm device of claim 4, wherein the first portion and the second portion completely separate when the first end and the second end are pulled in different directions a distance greater than twice the length of the elongating member.

6. The alarm device of claim 4, wherein the first portion and the second portion remain connected when the first end and the second end are pulled in different directions a distance less than to substantially equal to twice the length of the elongating member.

7. The alarm device of claim 4, wherein the elongating member is made of webbing.

8. The alarm device of claim 7, wherein the webbing of the first portion and the second portion are interwoven, the first portion and the second portion tearing apart from one another and separating as the first end and the second end are pulled in different directions.

9. An alarm device for use with a load limiting device, comprising:

a) an elongating member having a first end, a second end, and an interconnected portion interconnecting the first end and the second end, the interconnected portion being formed by a first portion and a second portion releasably connected to one another, the elongating member extending in length as the first end and the second end are pulled in different directions and the first portion and the second portion separating from one another as the first end and the second end are pulled in different directions, the first portion and the second portion completely separating when the first end and the second end are pulled in different directions a distance greater than twice the length of the interconnected portion;

b) an alarm operatively connected to the first end of the elongating member;

c) an activation member releasably connected to the alarm, the activation member activating the alarm when disconnected from the alarm; and d) a connecting member interconnecting the activation member and the second end of the elongating member, the activation member becoming disconnected from the alarm when the elongating member is extended in length as the first end and the second end are pulled in different directions thereby activating the alarm when the elongating member is extended.

10. The alarm device of claim 9, wherein the elongating member is made of webbing and the first portion and the second portion are interwoven and tear apart and separate as the first end and the second end are pulled in different directions.

11. An alarm device for use with a shock absorbing device to arrest a worker's fall, comprising:

a) an elongating member having a first end, a second end, and an interconnected portion interconnecting the first end and the second end, the interconnected portion being formed by a first portion and a second portion releasably connected to one another, the first portion and the second portion being operatively connected to one another proximate a terminal end of the interconnected portion, the elongating member extending in length as the first end and the second end are pulled in different directions and the first portion and the second portion separating from one another as the first end and the second end are pulled in different directions, the first portion and the second portion remaining connected proximate the terminal end when the first end and the second end are pulled in different directions a distance less than to substantially equal to twice the length of the interconnected portion thereby arresting the worker's fall;

b) an alarm operatively connected to the first end of the elongating member;

c) an activation member releasably connected to the alarm, the activation member activating the alarm when disconnected from the alarm; and d) a connecting member interconnecting the activation member and the second end of the elongating member, the activation member becoming disconnected from the alarm when the elongating member is extended in length as the first end and the second end are pulled in different directions thereby activating the alarm when the elongating member is extended.

12. The alarm device of claim 11, wherein the elongating member is made of webbing and the first portion and the second portion are interwoven and tear apart and separate as the first end and the second end are pulled in different directions.

13. A method of providing indication that a worker has been caught on an obstruction while being moved with a mechanical device, comprising:

a) providing an indicator having an activation member and a connecting member, the activation member being releasably connected to the indicator, the connecting member being operatively connected to the activation member, the activation member providing indication upon disconnection from the indicator;

b) providing an elongating member having a first end and a second end;

c) connecting the indicator to the first end;

d) connecting the connecting member to the second end thereby releasably interconnecting the first end and the second end of the elongating member with the indicator; and e) interconnecting the worker and the mechanical device with the elongating member, the activation member becoming disconnected from the indicator as the first end and the second end are pulled in different directions should the worker become caught on an obstruction thereby providing indication that the worker has been caught.

14. The method of claim 13, the indicator being an audio alarm.

15. The method of claim 13, the indicator being an illuminated light.

16. The method of claim 13, further comprising:

a) providing an intermediate portion interconnecting the first end and the second end, the intermediate portion having two portions that separate as the first end and the second end are pulled in different directions thereby increasing the length of the elongating member;

b) allowing the two portions of the intermediate portion to become completely separated; and c) providing a back-up fall arrest system.

17. A method of providing indication that a worker has been caught on an obstruction, comprising:

a) interconnecting a worker and a mechanical device with a cable;

b) moving the worker by the cable with the mechanical device;

c) providing an elongating member that increases the length of the cable when the worker has been caught on an obstruction and the mechanical device continues to move the cable;

d) providing indication when the elongating member begins to lengthen thereby indicating that the worker has been caught on the obstruction; and e) allowing an operator of the mechanical device time to stop movement of the mechanical device upon indication that the worker has been caught on the obstruction.

18. The method of claim 17, further comprising providing a back-up fall arrest system for the worker should at least a portion of the elongating member become disconnected from the cable.

19. A method of providing indication that a worker has fallen, comprising:

a) providing an indicator having an activation member and a connecting member, the activation member being releasably connected to the indicator, the connecting member being operatively connected to the activation member, the activation member providing indication upon disconnection from the indicator;

b) providing a shock absorbing device having a first end and a second end;

c) connecting the indicator to the first end;

d) connecting the connecting member to the second end thereby releasably interconnecting the first end and the second end of the shock absorbing device with the indicator; and e) interconnecting a worker and a support structure with the shock absorbing device, the activation member becoming disconnected from the indicator as the first end and the second end are pulled in different directions should the worker become subjected to the force of a fall.

* * * * *